US005148078A

United States Patent [19]

Kane

[11] Patent Number: 5,148,078

[45] Date of Patent: Sep. 15, 1992

[54] FIELD EMISSION DEVICE EMPLOYING A CONCENTRIC POST

[75] Inventor: Robert C. Kane, Woodstock, Ill.

[73] Assignee: Motorola, Inc., Schaumburg, Ill.

[21] Appl. No.: 575,104

[22] Filed: Aug. 29, 1990

[51] Int. Cl.[5] ..... H01J 1/30; H01J 19/24

[52] U.S. Cl. ..... 313/307; 313/308; 313/309; 313/355

[58] Field of Search ..... 313/307, 309, 310, 336, 313/308, 355

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. | 29/578 |
| 3,921,022 | 11/1975 | Levine | 313/309 |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,178,531 | 12/1979 | Alig | 313/409 |
| 4,307,507 | 12/1981 | Gray et al. | 313/309 |
| 4,513,308 | 4/1985 | Greene et al. | 313/309 |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,835,438 | 5/1989 | Baptist et al. | 313/309 |
| 4,874,981 | 10/1989 | Spindt | 313/309 |

FOREIGN PATENT DOCUMENTS

| | | |
|---|---|---|
| 0172089 | 7/1985 | European Pat. Off. . |
| 2604823 | 10/1986 | France . |
| 2204991A | 11/1988 | United Kingdom . |

OTHER PUBLICATIONS

A Vacuum Field Effect Transistor Using Silicon Field Emitter Arrays, by Gray, 1986 IEDM, Dec. 1986.

Advanced Technology: flat cold-cathode CRTs, by Ivor Brodie, Information Display, Jan. 1989.

Field-Emitter Arrays Applied to Vacuum Flourescent Display, by Spindt et al. Jan., 1989 issue of IEEE Transactions on Electronic Devices.

Field Emission Cathode Array Development for High--Current Density Applications by Spindt et al., dated Aug. 1982 vol. 16 of Applications of Surface Science.

*Primary Examiner*—Donald J. Yusko

*Assistant Examiner*—Ashok Patel

*Attorney, Agent, or Firm*—Eugene A. Parsons

[57] ABSTRACT

A device providing electric-field induced electron emission includes an annular edge for emission of charged particles. Particle emission is induced, at least in part, by the presence of a conducting or semi-conducting post within the periphery of the emitting edge.

8 Claims, 15 Drawing Sheets

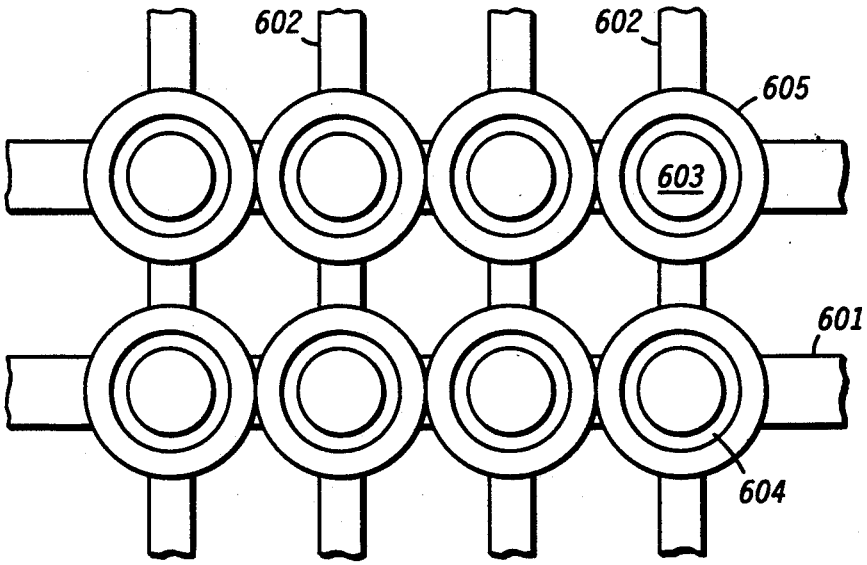
FIG. 6
600
700
FIG. 7
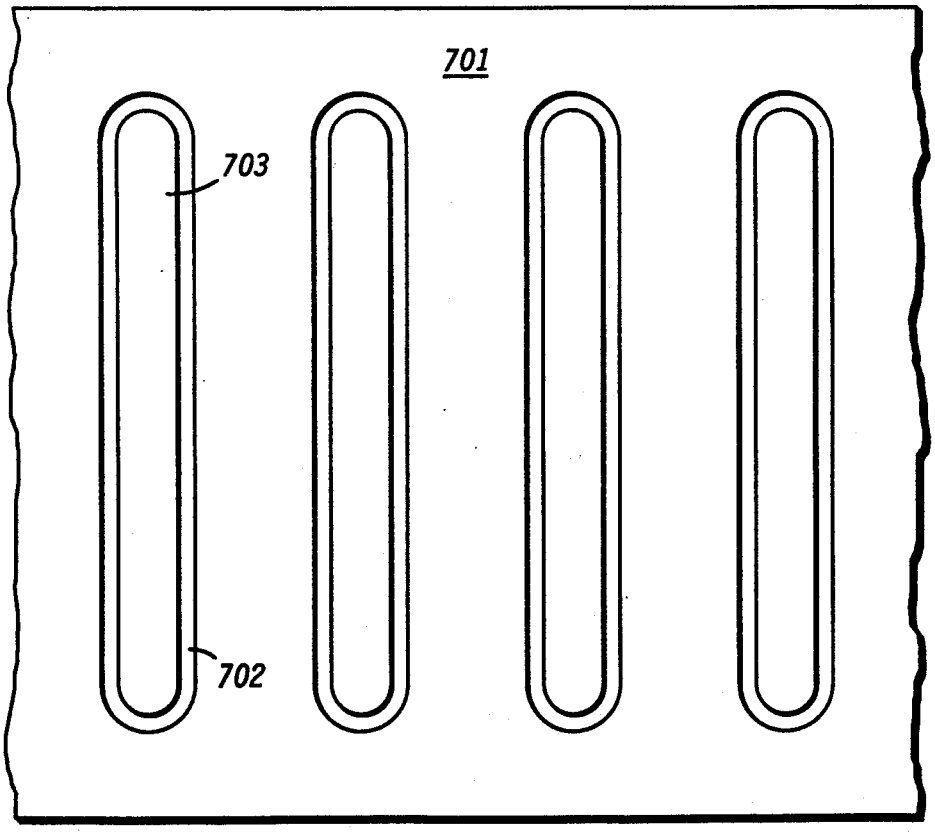

FIELD EMISSION DEVICE EMPLOYING A CONCENTRIC POST

TECHNICAL FIELD

This invention relates generally to cold-cathode field emission devices (hereinafter "FEDs") and more particularly to cold-cathode FEDs employing non-conical emitting edges.

BACKGROUND OF THE INVENTION

Cold-cathode FEDs are known in the art. Most FEDs include at least two electrodes, one known as the emitter and another known as the extractor, accelerating electrode, or gate electrode. Additional electrodes may be formed with the FED as applications warrant. These may be known as collector, anode, or focussing elements.

An FED emitter element may take a number of geometric forms. In one prior art FED, the emitter takes the shape of a cone. In another, the emitter is formed as a wedge. Electron emission occurs primarily from the tip of the cone-shaped structure, or, correspondingly, along the edge of the wedge-shaped structure.

There are several problems associated with the fabrication of such prior art FED structures. In order to form the cones or edges of conductor materials, prior art techniques employ multiple target vapor deposition methods. Since this complex fabrication process is not easily controlled, it is not well-suited for device manufacturing. An alternative method of emitter formation includes anisotropic etching of single-crystal semiconductor material. Although the process is less complex than the previously-described process, the use of semiconductor emitter material precludes high current operation of the device.

Accordingly, there exists a need for an improved FED with an emitter structure capable of being formed by a method that avoids some of the problems of the prior art devices.

SUMMARY OF THE INVENTION

Accordingly, an FED employing a concentric post is provided. Pursuant to this invention, a central electrode of conductive or semiconductive material (functioning, in part, as a gate electrode) provides a foundation for construction of the device, which also includes an annular emitting edge.

In one embodiment of an FED according to the invention, a series of selective etch and oxide growth-/deposition steps are employed during the formation process to yield a device with an annular emitter electrically isolated and concentrically located with respect to the central electrode. An additional conductive or semiconductive layer, electrically isolated from the emitter, is concentrically placed with respect to the central post. This additional layer acts in concert with the central post to form the complete gate extraction mechanism. The structure so formed does not require the complex deposition processes of the prior art nor does it suffer from prior art electron emission restrictions.

In another embodiment, an anode layer of conductive material is disposed substantially non-coplanar with respect to the gate electrode to collect emitted electrons, thereby forming a triode device.

In still another embodiment, a transparent plate coated with a suitable luminescent material may be included and disposed so as to cause at least some of the emitted electrons to impact the luminescent material thereby causing an image to be displayed at the transparent plate as a result of photon radiation.

In still other embodiments, further conductive layers may be disposed to form tetrode or pentode devices having additional electrodes.

BRIEF DESCRIPTION OF THE DRAWINGS

FIGS. 3A–J provide a series of side elevational cutaway depictions of structures resulting from various steps in constructing various embodiments of an FED in accordance with the invention.

FIG. 6 provides a top elevational view of an array of FEDs employing row/column conductor stripes.

FIG. 7 provides a top elevational view of an array of non-circular conductive posts with a common emitter conductor located annularly about each post.

FIGS. 8A–J provide a series of side elevational cutaway depictions of structures resulting from various steps in constructing various embodiments of an FED in accordance with the invention.

FIGS. 9A–J provide a series of side elevational cutaway depictions of structures resulting from various steps in constructing various embodiments of an FED in accordance with the invention.

DETAILED DESCRIPTION OF THE INVENTION

Figure 1:
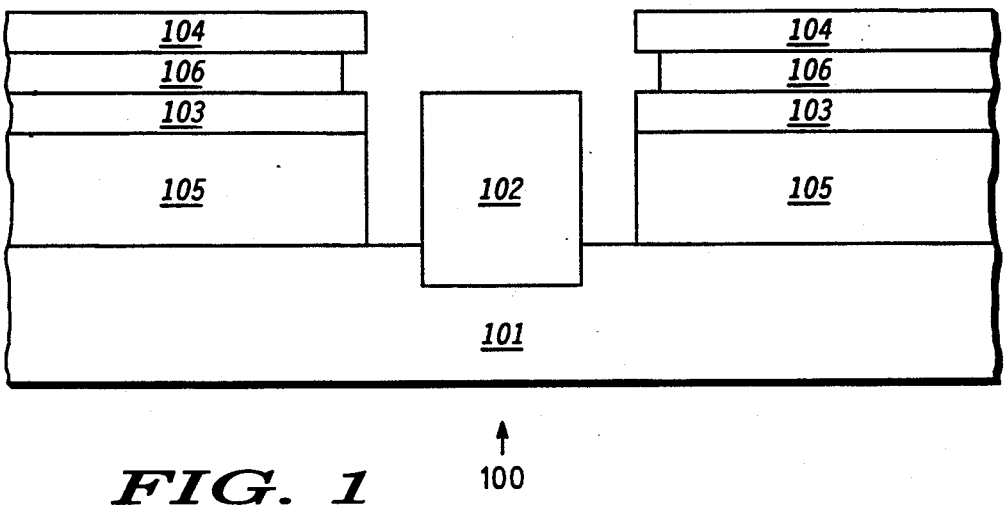
FIG. 1 provides a side elevational cutaway depiction of an FED structure including emitter and gate extraction electrodes.

Referring now to FIG. 1, there is shown a first embodiment of the invention. The FED (100) is formed with a substrate (101) and includes a central post electrode (102), a conductive emitter layer (103), a gate electrode layer (104), and insulating layers (105 and 106). The FED (100) is not shown to have an anode electrode on another insulating layer above the gate electrode (104).

Figure 2:
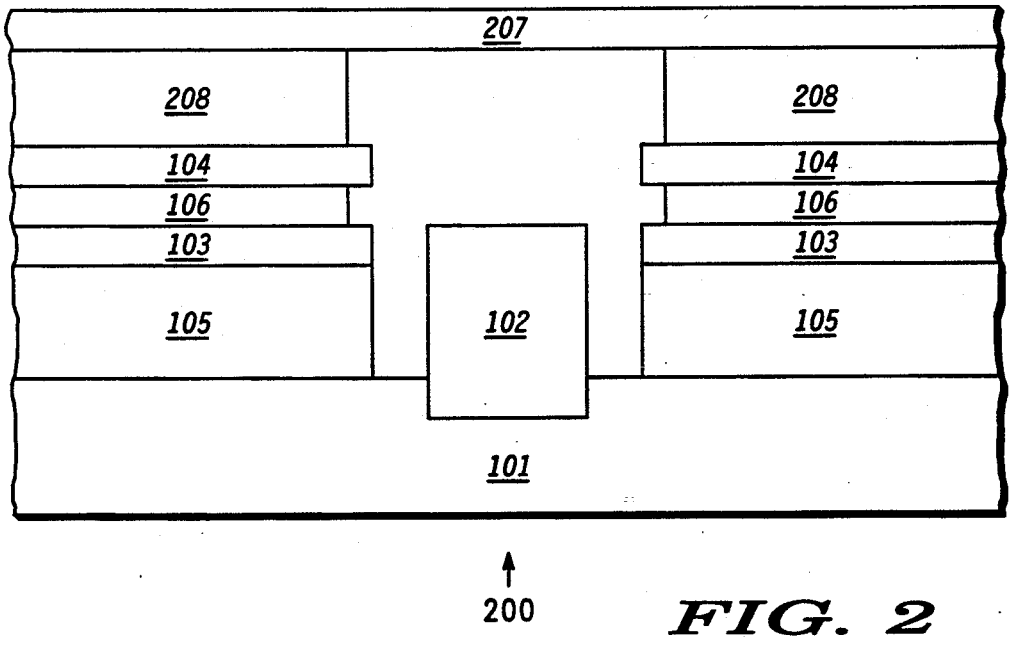
FIG. 2 provides a side elevational cutaway depiction of an FED structure including an insulated anode electrode located above the gate/emitter structure.

Referring now to FIG. 2, there is shown a second embodiment of the invention. There is shown an FED (200) constructed similar to FIG. 1, and including an anode electrode (207) positioned to intercept electrons emitted from the conductive emitter layer (103).

Referring still to FIG. 2, a first method of realizing the anode electrode (207) is through use of a conductive layer, either structurally self-supporting or residing on a supporting structure. The anode electrode (207) is properly positioned and electrically isolated with respect to the gate electrode layer (104) by means of an insulator layer (208). Alternatively, the anode electrode (207) may be realized as a transparent plate coated with luminescent and/or conductive materials.

A second method of realizing the anode electrode (207) is by employing a low-angle vapor deposition of conductive material. As the deposition proceeds, the chamber opening of the FED is closed over by the deposited material. Subsequent patterning of the deposited anode electrode (207) may be performed to yield optimum performance.

Figure 3A:
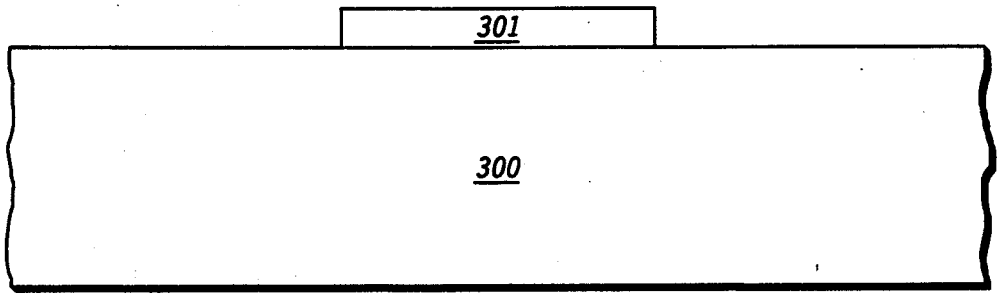
Figure 3B:
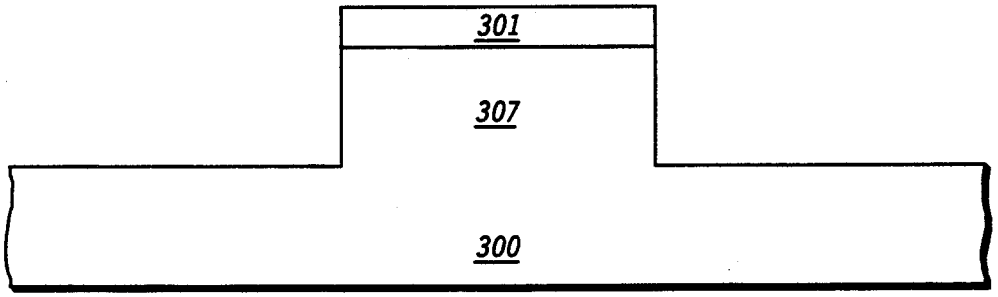
Figure 3C:
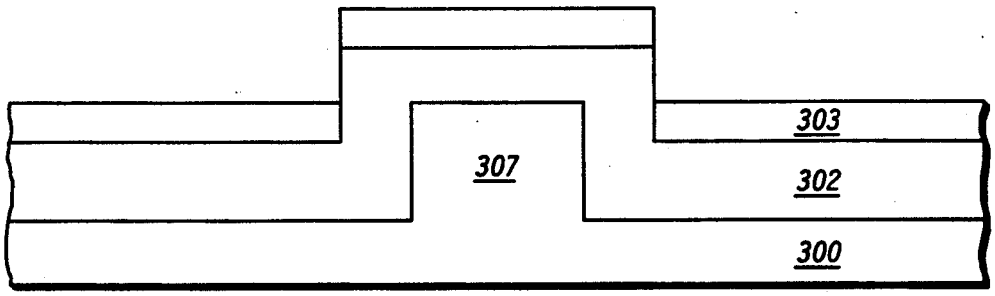
Figure 3D:
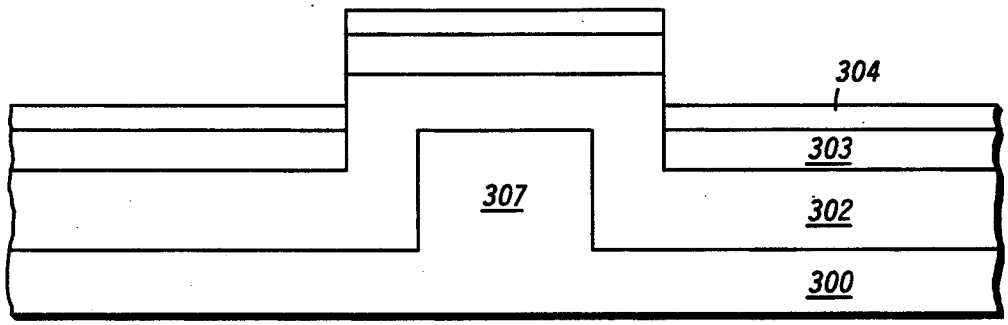
Figure 3E:
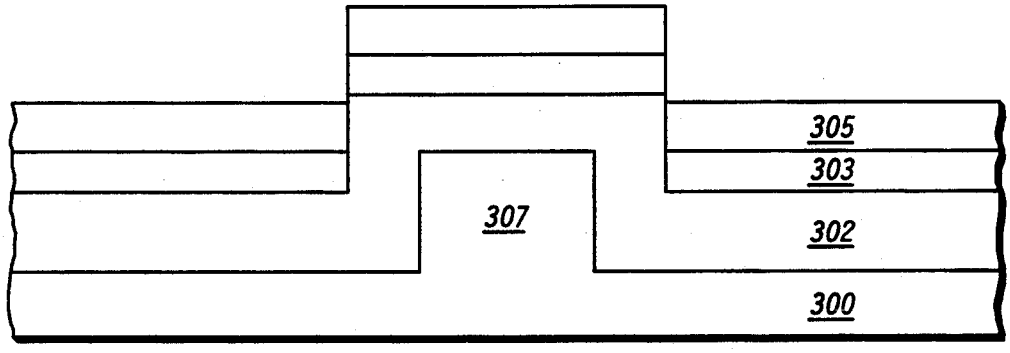
Figure 3F:
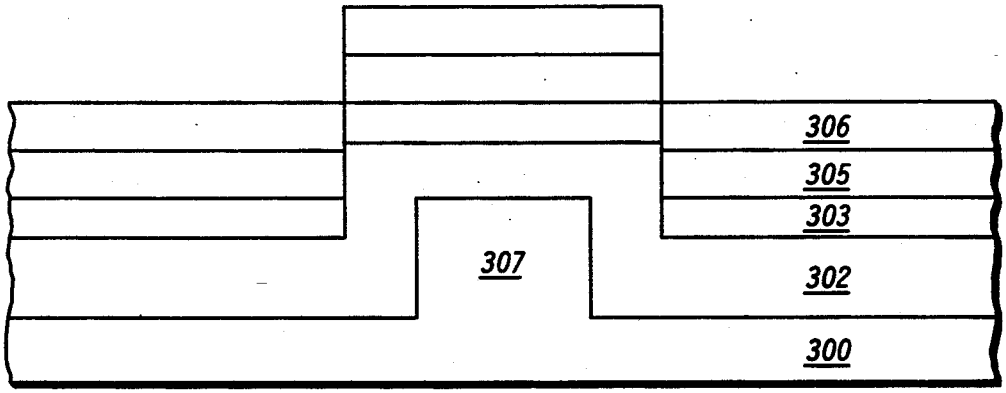
Figure 3G:
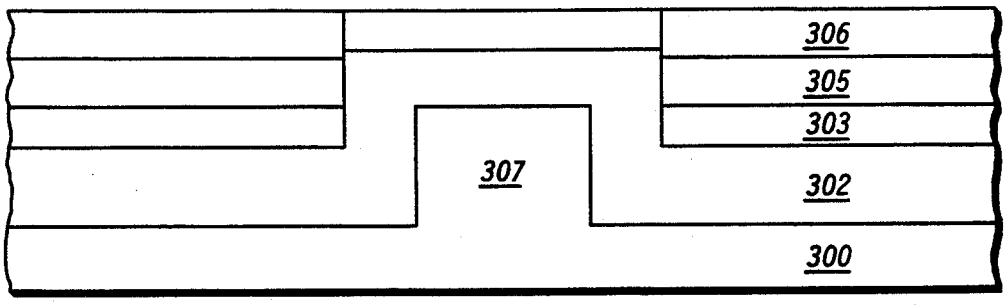
Figure 3H:
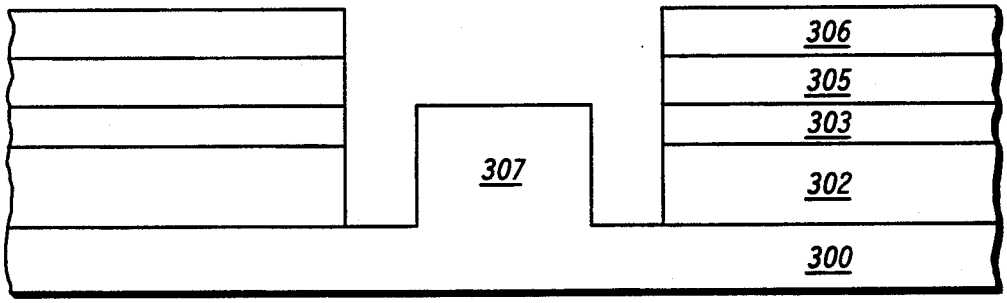
Figure 3J:
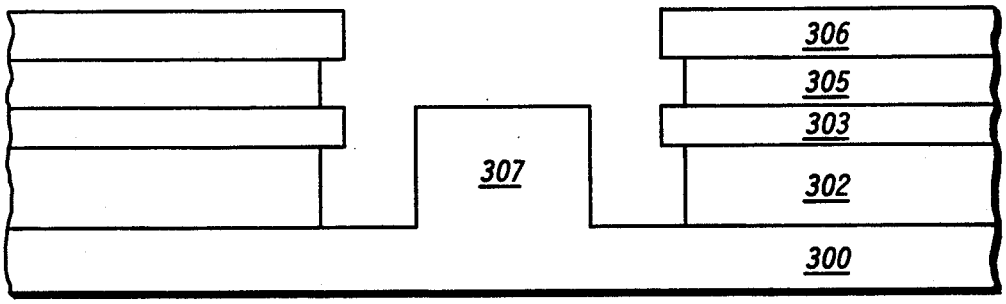

FIGS. 3A–3J show a first process suitable for fabricating FEDs in accordance with the invention. Referring now to FIG. 3A, there is shown an etch mask (301) that has been exposed, developed, patterned and disposed on a substrate layer (300). A suitable etch process is then performed to yield the structure shown in FIG. 3B, with a post (307) located beneath the etch mask (301) area. Subsequent removal of the etch mask (301) and growth of an insulator layer (302) is followed by the deposition of an conductive emitter layer (303), as shown in FIG. 3C. A silicon layer (304), as shown in FIG. 3D, may then be deposited and thermally oxidized to yield an insulator layer (305), as shown in FIG. 3E, or the insulator layer (305) may be directly deposited. As shown in FIG. 3F, a gate electrode layer (306) of conductive or semiconductive material is then deposited on the insulator layer. An oxide etch then removes the exposed insulator layer (305) material, as shown in FIG. 3G. Subsequent etching steps remove unwanted material from the region of the central post electrode (307), as shown in FIG. 3H. As shown in FIG. 3J, an isotropic oxide etch is then performed to achieve an over-etched condition so that the emitter conductive layer (303) and the gate electrode layer (306) will be at least partially extended beyond the insulator layers (302, 305).

Figure 4A:
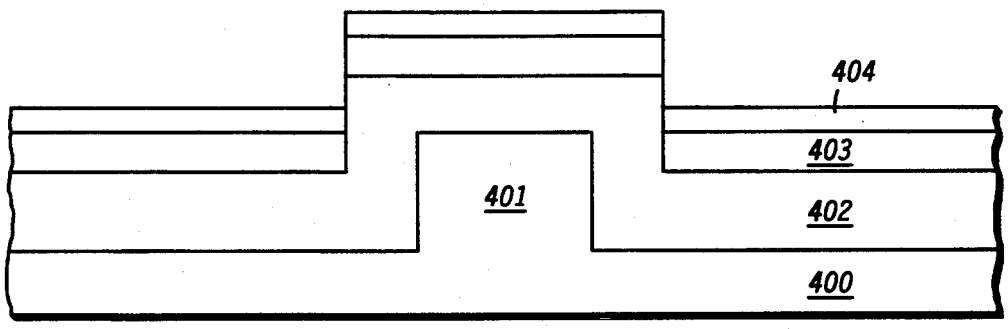
FIGS. 4A–G provide a series of side elevational cutaway depictions of structures resulting from various steps in constructing various embodiments of an FED in accordance with the invention.
Figure 4B:
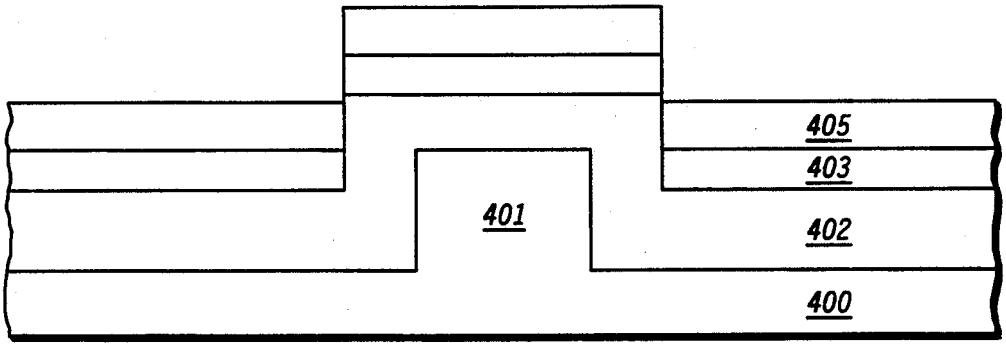
Figure 4C:
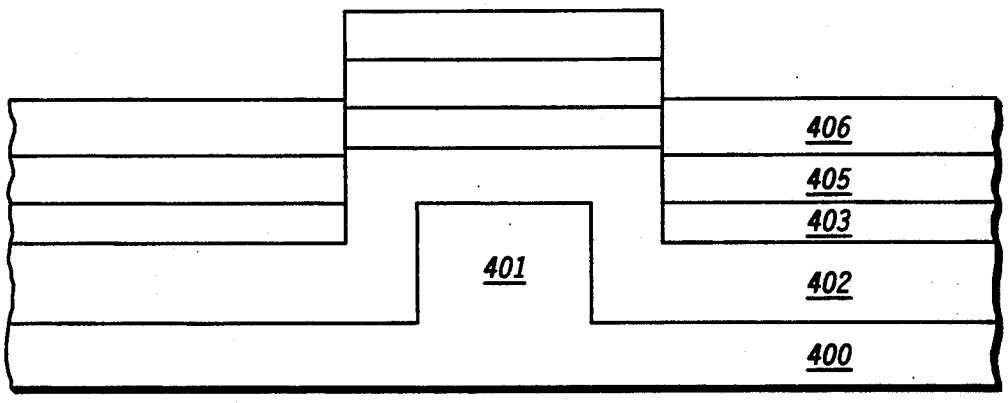
Figure 4D:
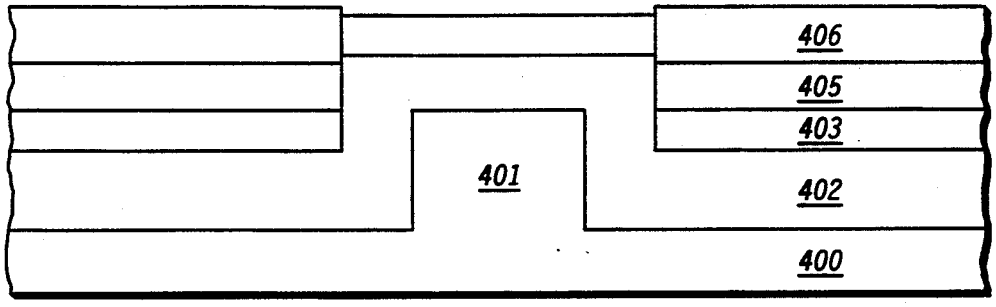
Figure 4E:
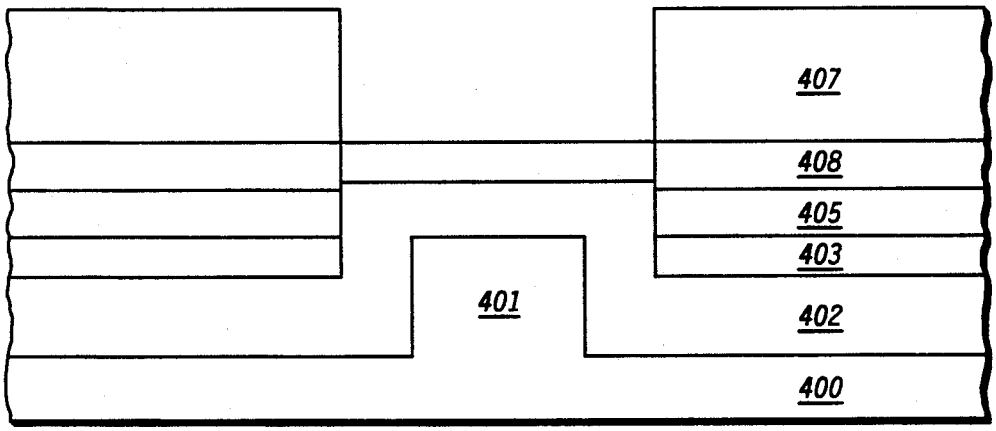
Figure 4F:
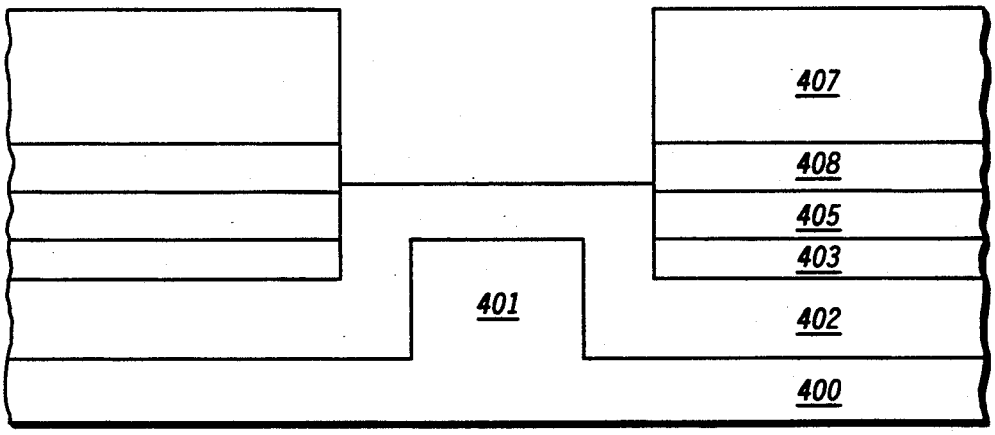
Figure 4G:
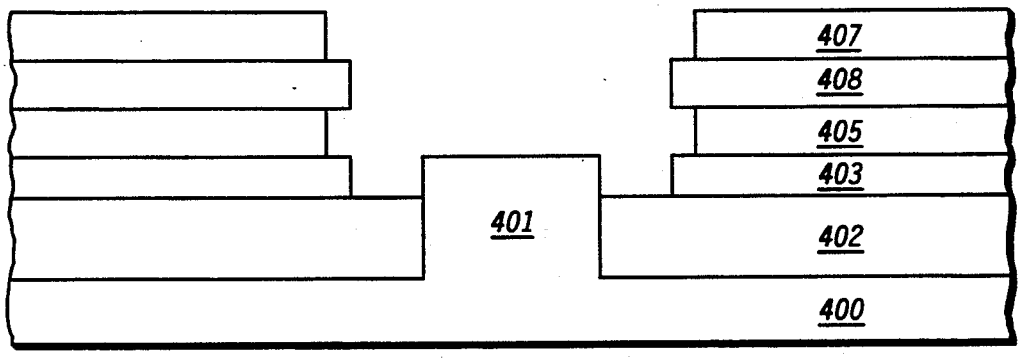

FIGS. 4A–4G show a second FED fabrication process in accordance with the invention. Referring now to FIG. 4A, there is shown a substrate (400) on which has been formed a central post electrode (401), an insulator layer (402), an emitter conductor layer (403) and a silicon layer (404). The silicon layer (404) is then thermally oxidized to provide an insulator layer (405), as shown in FIG. 4B. Alternatively, the insulator layer (405) may be deposited directly, precluding the need for deposition and oxidation of the silicon layer (404). Subsequently, a silicon layer (406) is deposited on the insulator layer (405), as shown in FIG. 4C. An oxide etch is next performed to remove unwanted portions of the insulator layer (405), as shown in FIG. 4D. An oxide growth is then performed, as shown in FIG. 4E, to provide an insulator layer (407) disposed on the silicon layer (406. In this embodiment, a portion of the silicon layer (406) is not oxidized and remains to function as the gate electrode layer (408) of the FED. An etch step is next performed to remove unwanted material from above the central post electrode (401) region, as shown in FIG. 4F. An oxide etch is performed, as shown in FIG. 4G, to expose at least a portion of the central post electrode (401) and to provide an over-etch of the insulator layers (402, 405, and 407) so that the edges of interest of the conductive emitter layer (403) and the gate electrode layer (408) are exposed.

Figure 5:
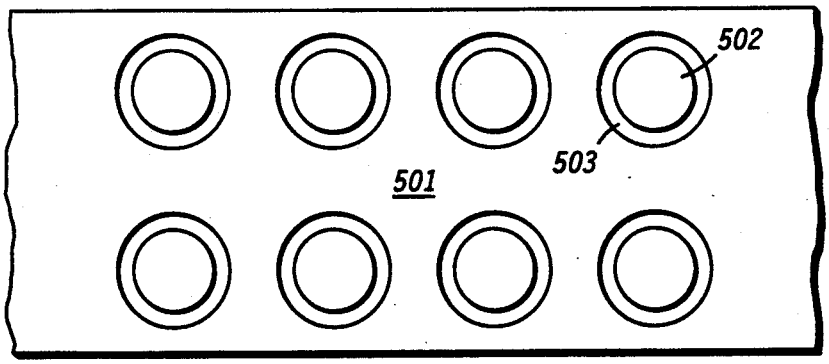
FIG. 5 provides a top elevational view of an array of central posts surrounded by a common emitter conductor located annularly about each post.

FIG. 5 provides a top-elevational view of a third embodiment of the invention. Referring now to FIG. 5, there is shown a plurality of FED device cells that are interconnected with each other and arranged in an array pattern. As shown, the conductive emitter layer (501) is formed of a single continuous layer and may, alternatively, be patterned in a manner so as to reduce objectionable capacitive effects by reducing the surface area of the conductive emitter layer (501). The conductive emitter layer (501) is further formed to provide annular openings (503) substantially peripherally about the central post electrodes (502). The plurality of FED device cells of FIG. 5 also include an anode electrode on another insulating layer (not shown in FIG. 5) above the emitter layer (501).

FIG. 6 provides a top-elevational view of a fourth embodiment. Referring now to FIG. 6, there is shown a top-elevational view of an array of FEDs employing row/column conductor stripes. As shown, a conductive emitter layer (601) is formed as a plurality of stripes with annular openings (604). The central post electrodes (603) are interconnected via a plurality of central post electrode stripes (602). The stripes (602) may be realized by selectively doping regions of the substrate prior to forming the central post electrodes. As shown, the central post electrodes (603) are disposed individually and substantially concentrically within an aperture region (604) defined as the interior of the annular region (605). further, a plurality of gate electrode stripes may be formed and operably connected to the conductive stripes interconnecting the central post electrodes of associated FEDs. The plurality of FED device cells of FIG. 6 also include an anode electrode on another insulating layer (not shown in FIG. 6) above the emitter layer (601).

FIG. 7 provides a top-elevational view of a fifth embodiment. Referring now to FIG. 7, there is shown a top-elevational view of a plurality of non-cylindrical central post electrodes (703) disposed substantially symmetrically with respect to the apertures (702) formed by the non-cylindrical annularly-shaped conductive emitter layer (701) edge. The FED device of FIG. 7 also includes an anode electrode on another insulating layer (not shown in FIG. 7) above the emitter layer (701).

Figure 8A:
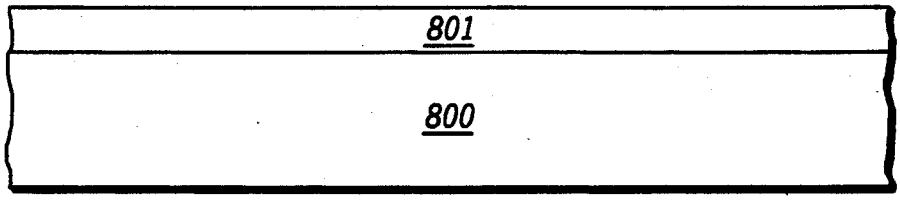
Figure 8B:
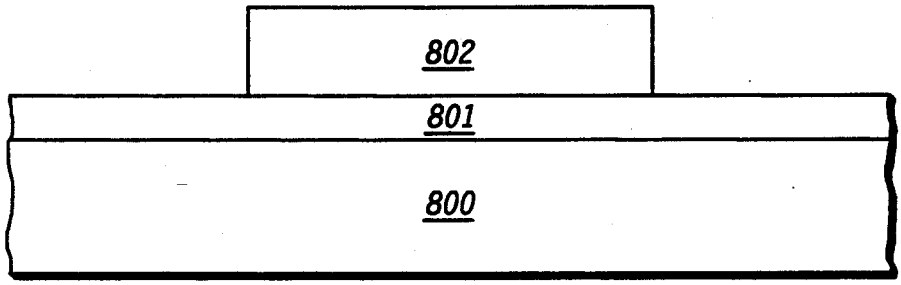
Figure 8C:
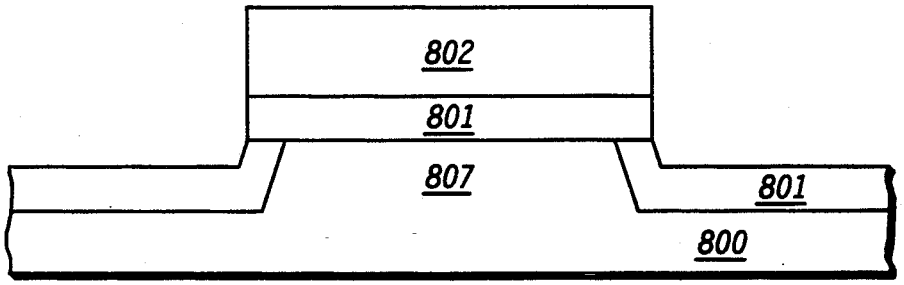
Figure 8D:
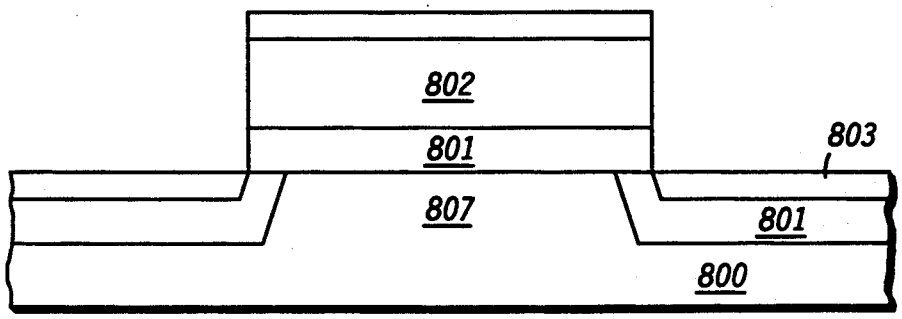
Figure 8E:
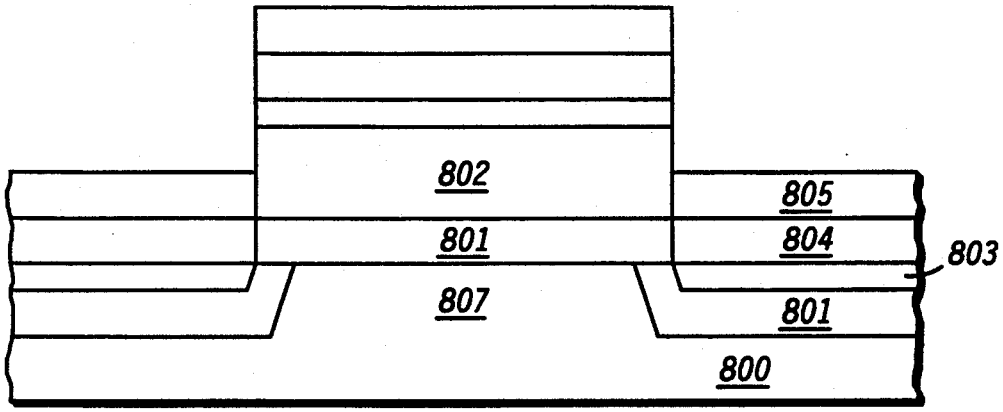
Figure 8F:
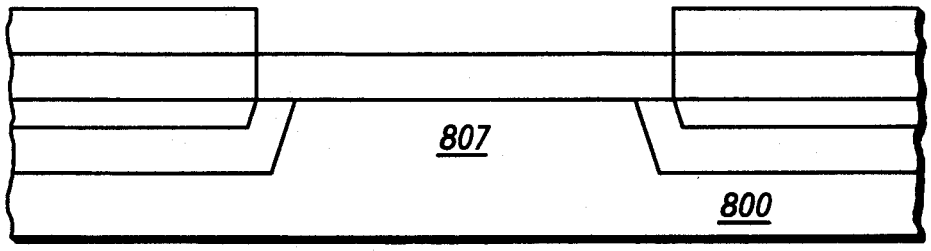
Figure 8G:
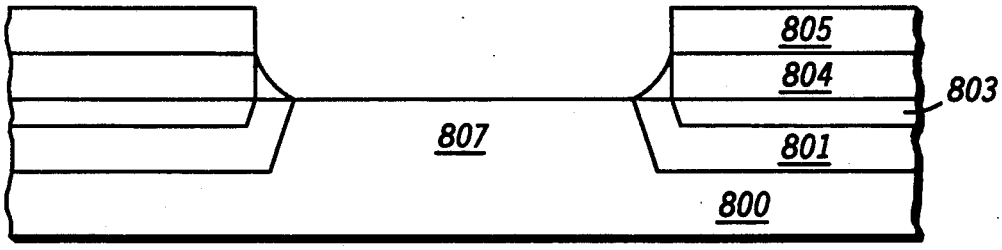
Figure 8H:
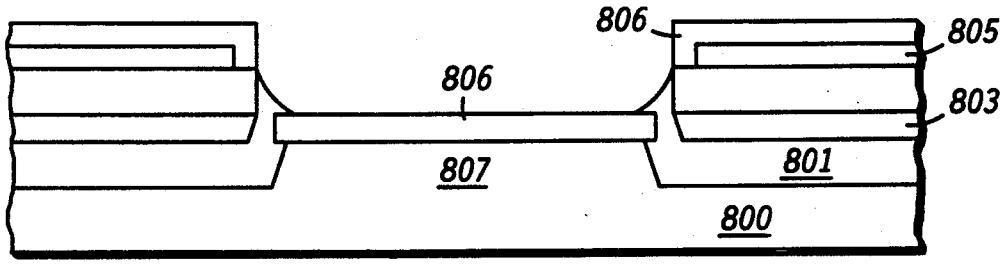
Figure 8J:
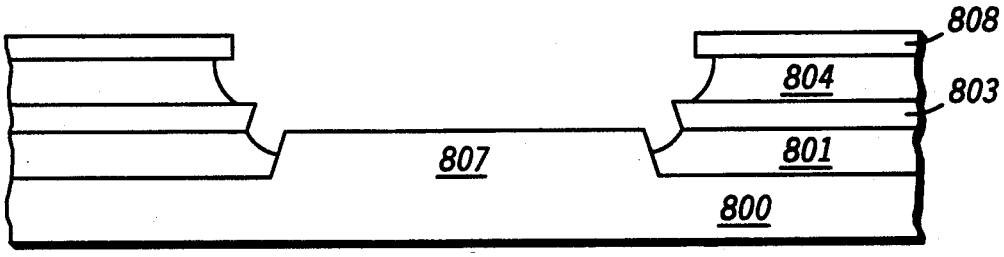

FIGS. 8A–8J depict a third process for fabricating FED units in accordance with the invention. Referring now to FIG. 8A, there is shown a substrate layer (800) supporting an insulator layer (801). A layer of photoresist is deposited, exposed, developed, and patterned to provide a photo mask (802) disposed on the insulator layer (801), as shown in FIG. 8B. A preferentially-directed oxide etch, such as reactive ion etch, is performed and followed by an anisotropic etch of the substrate layer (800) and a subsequent oxide growth, as shown in FIG. 8C. the conductive emitter layer (803) is deposited, as shown in FIG. 8D, followed by deposition of an insulator layer (804) and a silicon layer (805), as shown in FIG. 8E. The photo mask (802) is removed, as shown in FIG. 8F. and an oxide etch is performed, as shown in FIG. 8G. An oxide growth step forms an insulator layer (806) above the silicon layer (805), as shown in FIG. 8H. Subsequent non-directional oxide etching removes undesired insulator material to expose at least a portion of the central post electrode (807) and to provide an over-etch of the insulator layers (801 and 803) so that the edges of interest of the conductive emitter layer (803) and the gate electrode layer (808) are exposed, as shown in FIG. 8J. The gate electrode layer (808) is realized from the remaining unoxidized portion of the silicon layer (805).

Figure 9A:
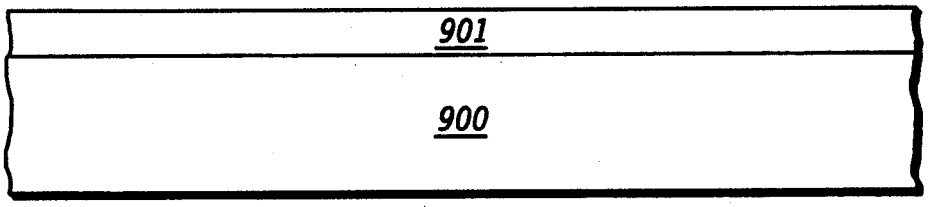
Figure 9B:
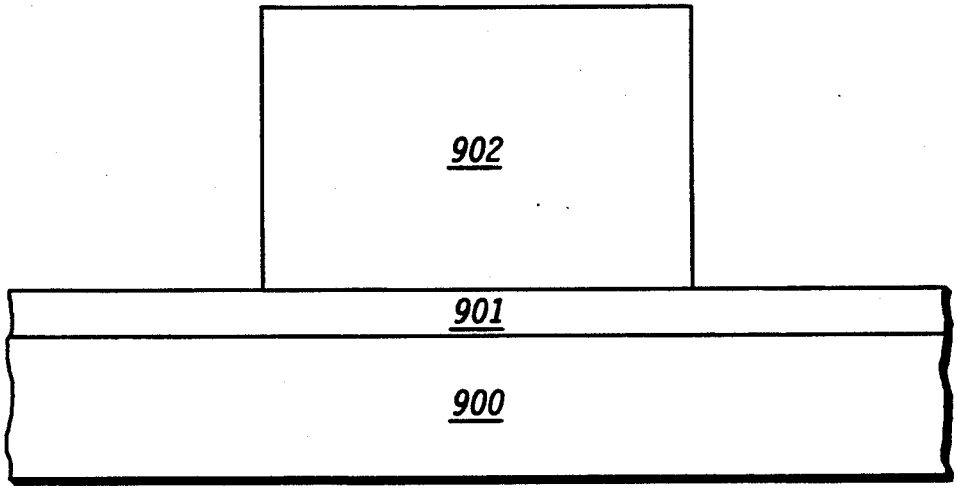
Figure 9C:
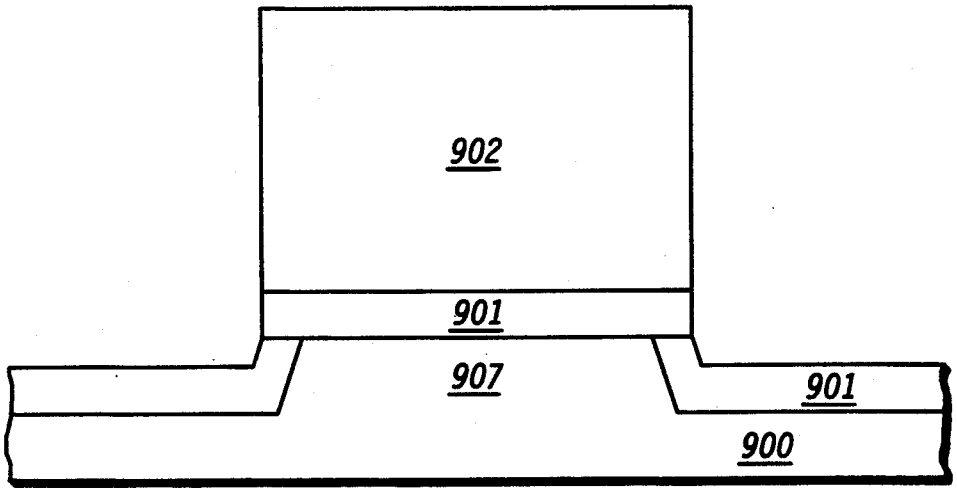
Figure 9D:
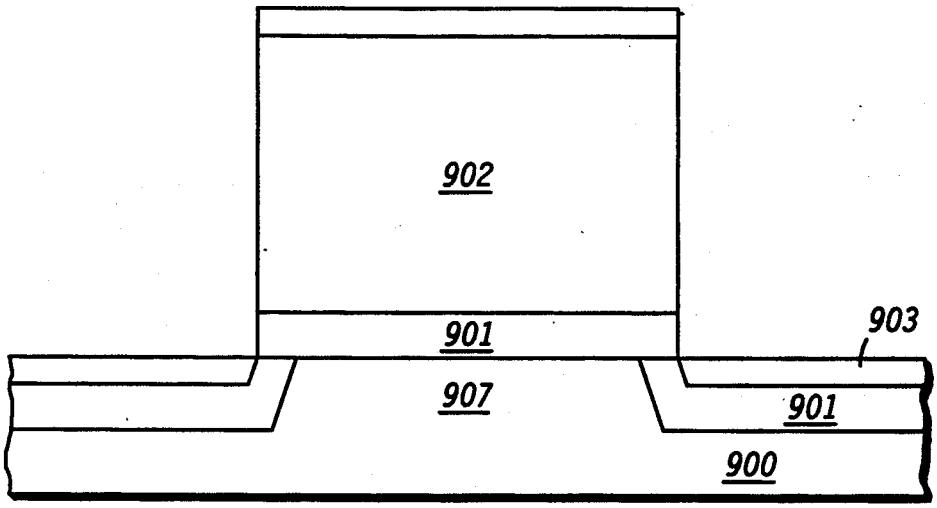
Figure 9E:
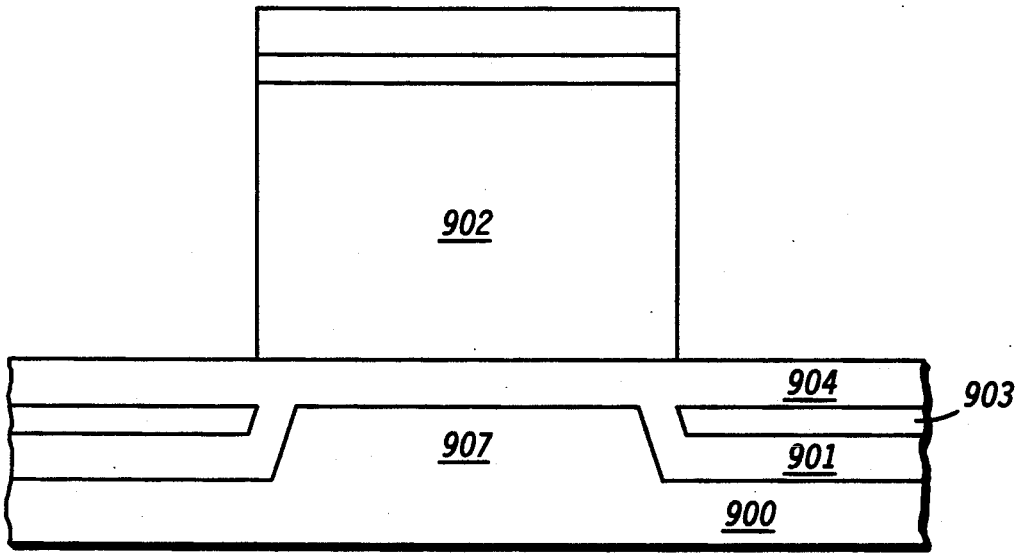
Figure 9F:
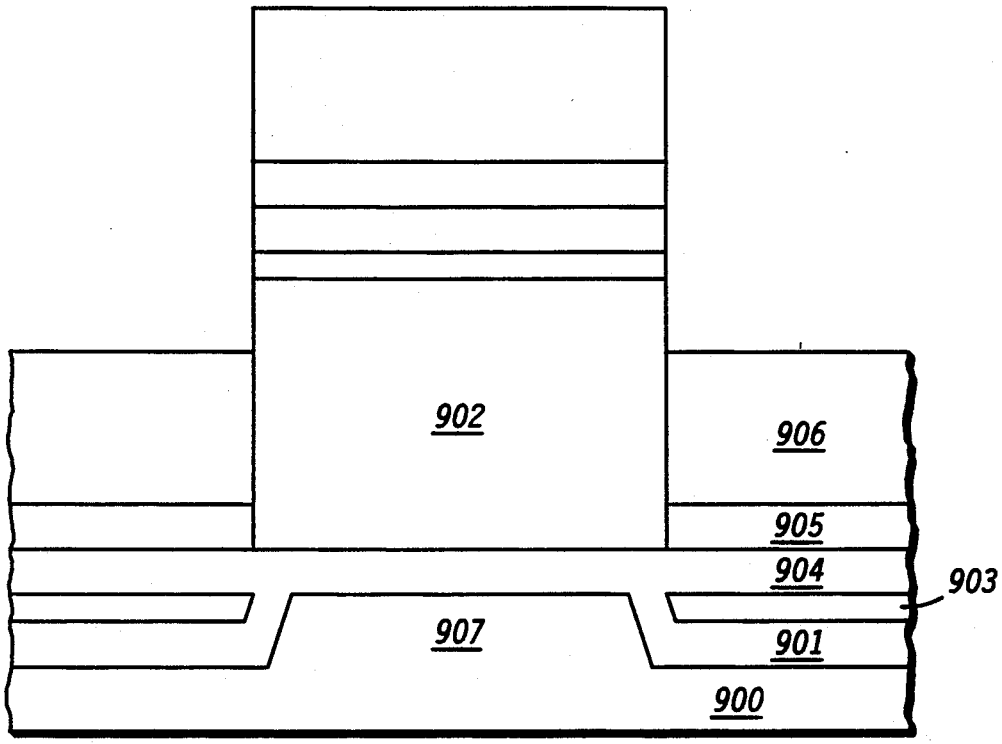
Figure 9G:
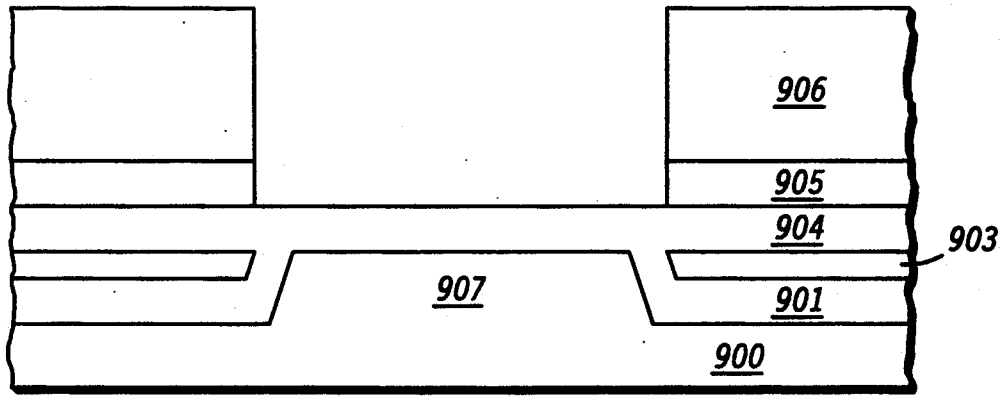
Figure 9H:
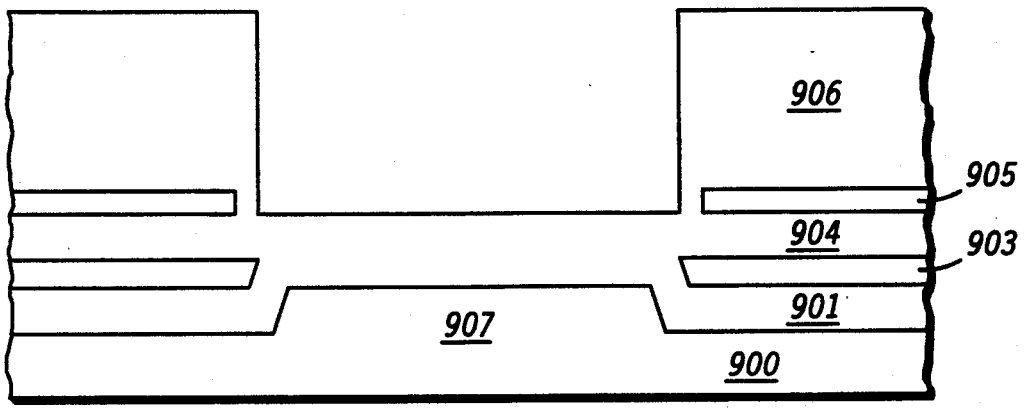
Figure 9J:
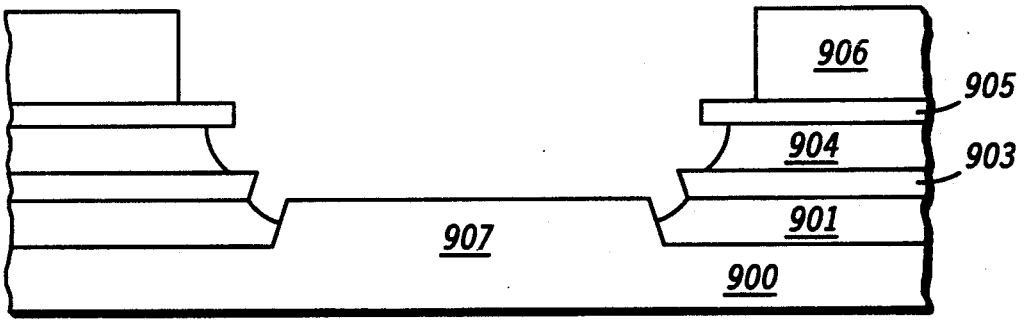

FIGS. 9A–9J depict a fourth FED fabrication process in accordance with the invention. Referring now to FIG. 9A, an insulator layer (901) is substantially supported on a first surface of a substrate layer (900). As shown in FIG. 9B, a photoresist material is deposited, exposed, developed, and patterned to form a photo mask (902) disposed on a surface of the insulator layer (901). As shown in FIG. 9C, a directional oxide etch of the insulator layer (901) is followed by an anisotropic etch of the substrate layer (900) and an oxide growth to reshape the substrate layer (900) and the insulator layer (901). The conductive emitter layer (903), as shown in FIG. 9D, is then deposited, followed by deposition of an insulator layer (904), as shown in FIG. 9E. A silicon layer (905) is next deposited followed by deposition of an insulator layer (906), as shown in FIG. 9F. The photo mask (902) is removed, as shown in FIG. 9G, and an oxide growth is performed, as shown in FIG. 9H. As shown in FIG. 9J, a non-directional oxide etch is performed to expose at least a portion of the central post electrode (907) and to provide an over-etch of the insulator layers (901, 904, and 906)k, so that the edges of interest of the conductive emitter layer (903) and the gate electrode layer (908) are exposed. As shown, the gate electrode layer (908) is realized from the remaining unoxidized portion of the silicon layer (905).

It will be apparent to those skilled in the art that alternative embodiments of FEDs may be constructed in accordance with this invention by employing metallic materials as gate electrode layers, in which instances, any requisite insulator layers, to be disposed on the gate electrode layer, may be realized as direct depositions or by deposition of a silicon layer followed by a suitable oxidation step. Where indicated in the preceding embodiments, it si advantageous to employ appropriately-doped silicon as the gate electrode layer so that the proximity of the annular edge of the gate electrode layer, with respect to the annular edge of the conductive emitter layer edge, can be optimized by the prescribed oxidation and etch steps.

It will further be apparent to those skilled in the art that an FED in accordance with the present invention may be arranged to emit electrons from the annular edge of the conductive emitter layer.

What is claimed is:

1. A field emission device comprising:

a substrate having a surface;

a central post electrode extending from said substrate surface;

a first insulator layer disposed on said substrate surface and further disposed in a substantially annular and concentric fashion about said central post electrode;

a conductive emitter layer disposed on said first insulator layer and further disposed in a substantially annular and concentric fashion about said central post electrode;

a second insulator layer disposed on said conductive emitter layer and further disposed in a substantially annular and concentric fashion about said central post electrode;

a gate electrode layer disposed on said second insulator layer and further disposed in a substantially annular and concentric fashion about said central post electrode;

a third insulator layer disposed on said gate electrode layer and further disposed in a substantially annular and concentric fashion about said central pot electrode; and an anode electrode layer disposed non-coplanar with said gate electrode layer.

2. A field emission device comprising:

a substrate having a surface;

a plurality of central post electrodes extending from said substrate surface;

a first insulator layer disposed on said substrate surface in a substantially annular and concentric fashion about individual central post electrodes;

a conductive emitter layer disposed on said first insulator layer in a substantially annular and concentric fashion about at least some of said individual central post electrodes;

a second insulator layer disposed on said conductive emitter layer in a substantially annular and concentric fashion about at least some of said individual central post electrodes;

a gate electrode layer disposed on said second insulator layer in a substantially annular and concentric fashion about at least some of said individual central post electrodes;

a third insulator layer disposed on said gate electrode layer and further disposed in a substantially annular and concentric fashion about said central post electrodes; and an anode electrode layer disposed non-coplanar with said gate electrode layer.

3. The field emission device of claim 2 wherein said anode electrode layer comprises conductive material proximally located with respect to said conductive emitter layer to collect electrons emitted therefrom.

4. A field emission device comprising:

a substrate having a surface;

a plurality of central post electrodes extending from said substrate surface;

a first insulator layer disposed on said substrate surface in a substantially annular and concentric fashion about individual central post electrodes;

a conductive emitter layer disposed on said first insulator layer in a substantially annular and concentric fashion about said individual central post electrodes;

a second insulator layer disposed on said conductive emitter layer in a substantially annular and concentric fashion about said individual central post electrodes;

a gate electrode layer disposed on said second insulator layer and comprising a plurality of electrically-isolated stripes each disposed in a substantially annular and concentric fashion about several individual central post electrodes;

a third insulator layer disposed on said gate electrode layer and further disposed in a substantially annular and concentric fashion about said central post electrodes; and an anode electrode layer disposed non-coplanar with said gate electrode layer.

5. A field emission device comprising:

a substrate having a surface;

a plurality of central post electrodes extending from said substrate surface;

a first insulator layer disposed on said substrate surface in a substantially annular and concentric fashion about individual central post electrodes;

a conductive emitter layer disposed on said first insulator layer and comprising a plurality of electrically-isolated stripes each disposed in a substantially annular and concentric fashion about several individual central post electrodes;

a second insulator layer disposed on said conductive emitter layer in a substantially annular and concentric fashion about said individual central post electrodes;

a gate electrode layer disposed on said second insulator layer in a substantially annular and concentric fashion about said individual central post electrodes;

a third insulator layer disposed on said gate electrode layer and further disposed in a substantially annular and concentric fashion about said central post electrodes; and an anode electrode layer disposed non-coplanar with said gate electrode layer.

6. A field emission device comprising:

a substrate having a surface;

a plurality of patterned central post conductive stripes disposed on said surface and having disposed thereon a plurality of central post electrodes, said central post electrodes extending from said substrate surface;

a first insulator layer disposed on said substrate surface and further disposed in a substantially annular and concentric fashion about said plurality of central post electrodes;

a conductive emitter layer disposed on said first insulator layer and further disposed as a plurality of stripes with annular openings substantially surrounding said plurality of central post electrodes;

a second insulator layer disposed on said conductive emitter layer in a substantially annular and concentric fashion about said plurality of central post electrodes;

a plurality of gate electrode stripes disposed on said second insulator layer in a substantially annular and concentric fashion about said central post electrodes;

a third insulator layer disposed on said gate electrode stripes and further disposed in a substantially annular and concentric fashion about said central post electrodes; and an anode electrode layer disposed non-coplanar with said gate electrode stripes.

7. The field emission device of claim 6 wherein said central post electrodes are operably connected to said patterned central post conductive stripes.

8. The field emission device of claim 7 wherein each of the plurality of gate electrode stripes is operably connected to only the corresponding central post conductive stripe of the plurality of central conductive stripes associated with other FEDs common to both the gate electrode stripe and central post conductive stripe.

* * * * *